US010038275B2

(12) United States Patent
Stockinger et al.

(10) Patent No.: US 10,038,275 B2
(45) Date of Patent: Jul. 31, 2018

(54) STACKABLE DEFORMABLE ELECTRICAL CONNECTOR SYSTEM

(71) Applicant: EVERLAST CLIMBING INDUSTRIES, INC., Minneapolis, MN (US)

(72) Inventors: Chris Stockinger, Loveland, CO (US); Eric Solanyk, Loveland, CO (US); Anne Jordan, Ft. Collins, CO (US); Pete Schiel, Denver, CO (US); Michael Medina-Brodsky, Longmont, CO (US)

(73) Assignee: EVERLAST CLIMBING INDUSTRIES, INC., Minneapolis, MN (US)

( * ) Notice: Subject to any disclaimer, the term of this patent is extended or adjusted under 35 U.S.C. 154(b) by 0 days.

(21) Appl. No.: 15/891,701

(22) Filed: Feb. 8, 2018

(65) Prior Publication Data

US 2018/0166823 A1 Jun. 14, 2018

Related U.S. Application Data

(63) Continuation-in-part of application No. 15/120,583, filed as application No. PCT/US2015/017433 on Feb. 25, 2015.

(Continued)

(51) Int. Cl.
*H01R 11/22* (2006.01)
*H01R 13/533* (2006.01)
(Continued)

(52) U.S. Cl.
CPC ..... *H01R 13/533* (2013.01); *H01R 13/52* (2013.01); *H01R 13/631* (2013.01)

(58) Field of Classification Search
CPC ..... H01R 13/193
(Continued)

(56) References Cited

U.S. PATENT DOCUMENTS 2,493,457 A 1/1950 Kenure et al.
2,830,280 A 4/1958 Webber
(Continued)

FOREIGN PATENT DOCUMENTS

WO 2015130736 A2 9/2015

OTHER PUBLICATIONS

International Search Report and Written Opinion corresponding to International Patent Application No. PCT/US2015/17433, dated Jun. 4, 2015.

(Continued)

*Primary Examiner* — Phuong Dinh
(74) *Attorney, Agent, or Firm* — McAndrews, Held & Malloy, Ltd.

(57) ABSTRACT

A stackable connector system having upper and lower members is provided. The upper member has a first set of upper connections including studs or jacks and a second set of upper connections including studs or jacks that are opposite the first set of upper connections. The lower member includes a first set of lower connections including studs or jacks that are opposite the second set of upper connections. The second set of upper connections and the first set of lower connections have parallel axes that are misaligned in an unplugged state. The misalignment creates deformation of the upper member and/or lower member during insertion of the studs into the jacks when the second set of upper connections and the first set of lower connections are plugged together. The deformation creates a resultant force between the second set of upper connections and the first set of lower connections.

17 Claims, 10 Drawing Sheets

Related U.S. Application Data

(60) Provisional application No. 61/945,622, filed on Feb. 27, 2014.

(51) Int. Cl.
*H01R 13/631* (2006.01)
*H01R 13/52* (2006.01)

(58) Field of Classification Search
USPC ..... 439/269.2, 252, 146
See application file for complete search history.

(56) References Cited

U.S. PATENT DOCUMENTS

| | | | | |
|---|---|---|---|---|
| 2,850,711 | A | | 9/1958 | Terlinde |
| 2,923,909 | A | | 2/1960 | Modrey |
| 3,013,242 | A | * | 12/1961 | Terlinde ..... H01R 13/193 439/269.2 |
| 3,581,272 | A | | 5/1971 | Yopp |
| 4,105,277 | A | | 8/1978 | Jacobs |
| 4,299,431 | A | | 11/1981 | Wilson |
| 4,795,375 | A | | 1/1989 | Williams |
| 5,919,066 | A | | 7/1999 | Harting et al. |
| 7,220,136 | B1 | | 5/2007 | Green |
| 8,602,815 | B2 | | 12/2013 | Stockinger et al. |
| 2009/0215288 | A1 | | 8/2009 | Miyazaki et al. |
| 2011/0151698 | A1 | | 6/2011 | Boyd |
| 2013/0059465 | A1 | | 3/2013 | Stockinger et al. |

OTHER PUBLICATIONS

PCT, International Preliminary Report on Patentability and Written Opinion corresponding to International Patent Application No. PCT/US2015/017433, dated Sep. 9, 2016, 9 pages.

* cited by examiner

STACKABLE DEFORMABLE ELECTRICAL CONNECTOR SYSTEM

CROSS-REFERENCE TO RELATED APPLICATIONS/INCORPORATION BY REFERENCE

The present application is a continuation-in-part of U.S. patent application Ser. No. 15/120,583, filed Aug. 22, 2016, which is the U.S. national phase under § 371 of International Application No. PCT/US2015/017433, having an international filing date of Feb. 25, 2015, which claims priority to provisional application Ser. No. 61/945,622, filed Feb. 27, 2014, entitled "Connector System for the Aquatic Environment." Each of the above-mentioned prior-filed applications is hereby expressly incorporated herein by reference in its entirety.

U.S. Pat. No. 8,602,815, issued to Stockinger et al. on Dec. 10, 2013, is incorporated by reference herein in its entirety.

FIELD

Certain embodiments relate to electrical connectors. More specifically, certain embodiments relate to an electrical connector system having misaligned, deformable electrical connectors. In various embodiments, at least some of the electrical connectors may be stackable. The electrical connectors may be implemented, for example, in an electronic system installed in a corrosive environment (e.g., near a pool) and configured to provide timing and scoring of aquatic sports.

BACKGROUND

Existing electronic timing and scoring systems installed at a pool acquire times and scores of athletes using various timing and scoring components, such as touch pads, buttons, relay judging platforms, speakers, lights, judging terminals, and the like. These timing and scoring components are connected to an electronic control device through mechanisms such as connection hubs or cable harnesses to form the electronic timing and scoring system.

Typically, connector hubs and/or cable harnesses are situated on a pool deck and provide mating connections to connectors of the timing and scoring components. The connector hubs and harnesses are often repeatedly splashed with pool water due to being positioned in close proximity to a pool. Pool water contains aggressive chemicals such as chlorine, bromine, and other chemicals that are corrosive to materials, such as metals, that are used in electrical connectors. The corrosive effect of the pool water can be intensified by electrolysis when the pool water sits in a puddle on hubs or harnesses creating a bridge between the electrical connectors of one or several mating connections. Specifically, the signal voltage for the connected devices (typically 3.3 VDC or 5 VDC) creates a potential difference between the electrical contacts, which creates an electrolytic current through the slightly conductive water bridge between the electrical connectors. The electrolysis leads to faster corrosion of the electrical contacts.

In addition to gradually destructing the materials of the electrical connection, corrosion reduces a signal to noise ratio of the connection because the corroded electrical contacts add to the serial resistance in the signal path. Consequently, a signal may become unreadable by the control device in cases of strong corrosion such that the electrical contacts may need cleaning or replacement to resume operation. Frequent cleaning of the electrical contacts to counteract corrosion and maintain clean, well conducting surfaces, however, may render the long term effect of corrosion worse by abrading protective layers of the electrical contacts.

U.S. Pat. No. 8,602,815, issued to Stockinger et al. on Dec. 10, 2013, which is incorporated by reference herein in its entirety, describes embodiments of connection hubs having a profile that allows water to flow off to reduce the effects of corrosion. Existing systems have used "banana plugs" to provide a large and robust connector system that can withstand some corrosion. Typically, the banana plugs include two terminals at a distance of 0.75 inch and are provided by the timing components. The connection hubs and harnesses provide the mating banana jacks. For example, a connection hub may provide connection jacks for push buttons, a touch pad, a start input, a relay judging platform signal, a start signal output for a visual start signal, and a speaker output. A cable harness may provide connection jacks for a touch pad input and a button input for each lane.

The male counterparts of the connectors are usually built as a metal stud having a spring member integrated around the stud to make durable, secure electrical contact within the female jack. The studs are typically steel or brass, with nickel and tin or gold plating, which are susceptible to corrosion. The springs are typically beryllium copper alloys with nickel and tin or gold plating. The spring forces urge the male stud into contact with the walls of the female jack when the stud is inserted into the jack. The force provided by the spring compensates for mechanical tolerances and abrasion over time.

Corrosion resistant materials, such as titanium, may have properties similar to stainless steel, which is hard and highly inflexible. For example, titanium is not as flexible as the beryllium copper alloys typically employed to create enduring springs with a large range of spring deflection. Consequently, it may be difficult or undesirable to manufacture traditional spring contacts out of titanium alone.

Further limitations and disadvantages of conventional and traditional approaches will become apparent to one of skill in the art, through comparison of such systems with some aspects of the present disclosure as set forth in the remainder of the present application with reference to the drawings.

BRIEF SUMMARY

A connector system having stackable, misaligned, deformable electrical connectors is provided, substantially as shown in and/or described in connection with at least one of the figures, as set forth more completely in the claims.

These and other advantages, aspects and novel features of the present disclosure, as well as details of an illustrated embodiment thereof, will be more fully understood from the following description and drawings.

DETAILED DESCRIPTION

Figure 1:
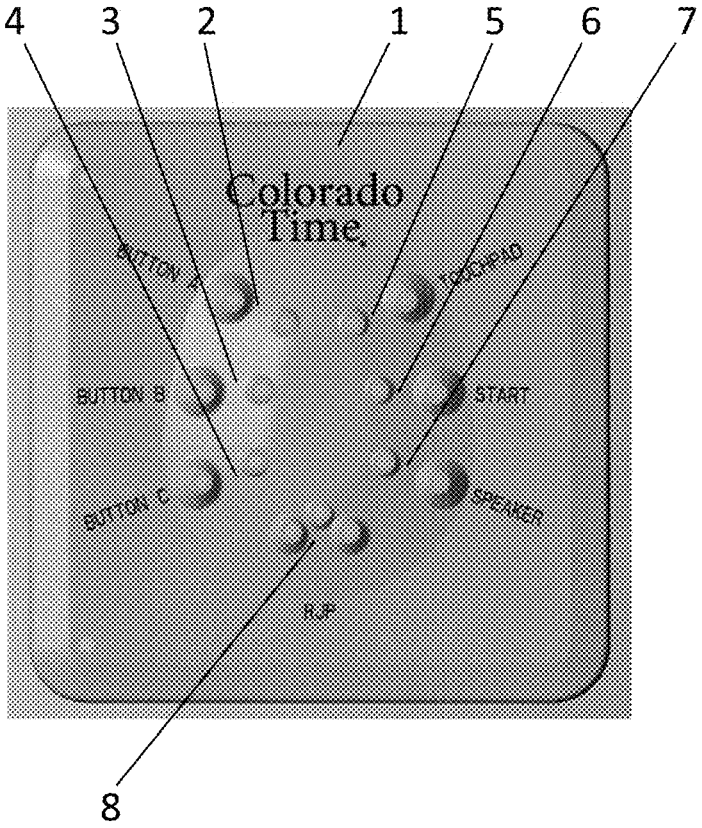
FIG. 1 is a top elevation view of an exemplary connection hub, in accordance with an embodiment of the disclosure.

Certain embodiments may be found in electrical connectors. More specifically, certain embodiments provide an electrical connector system having stackable, misaligned, deformable electrical connectors. An exemplary embodiment aids users by providing corrosion resistant plugs and jacks that create resultant forces by misaligning the plugs and jacks such that conventional corroding spring members may be eliminated.

Various embodiments provide a connector system comprising a stackable upper member 30 and a lower member 29. The stackable upper member 30 may comprise an upper member body 18 holding a first set of connections comprising at least one of a plurality of studs 14, 15, 35 and a plurality of jacks 10, 11, 31. The lower member 29 may comprise a lower member body holding lower connections comprising at least one of the plurality of studs 14, 15, 35 and the plurality of jacks 10, 11, 31 that are opposite and correspond with the first set of connections. The first set of connections and the lower connections having parallel axes 12, 13, 16, 17, 32, 36 that are misaligned 21, 22, 26-28, 33, 34 in an unplugged state. The misalignment creates deformation (see FIGS. 4A, 4B, 7B, 9B, 10, 11B, 12, 14A, 15A, and 15B) of at least one of the upper member 30 and the lower member 29 when the first set of connections and the lower connections are plugged together. The deformation creates a resultant force between the first set of connections and the lower connections. The upper member body 18 of the stackable upper member 30 may comprise a second set of connections comprising at least one of a plurality of studs 14, 15, 35 and a plurality of jacks 19, 20, 31 that are opposite with the first set of connections. The second set of connections allows an additional upper member 30 to be stacked onto the stackable upper member 30. In certain embodiments, the first set of connections may be different in numbers than the second set of connections. In an exemplary embodiment, an electronic control device coupled to the lower member 29 may communicate with a set of timing and scoring components via any suitable number of corresponding connected stacked upper members 30. For example, multiple touch pads may each be coupled to an upper member 30 and each of the upper members 30 may be stacked and connected to the lower member 29.

As used herein, the terms "exemplary" or "example" means serving as a non-limiting example, instance, or illustration. As used herein, the term "e.g." introduces a list of one or more non-limiting examples, instances, or illustrations.

The foregoing summary, as well as the following detailed description of certain embodiments will be better understood when read in conjunction with the appended drawings. It should be understood that the various embodiments are not limited to the arrangements and instrumentality shown in the drawings. It should also be understood that the embodiments may be combined, or that other embodiments may be utilized and that structural, logical and electrical changes may be made without departing from the scope of the various embodiments of the present disclosure. The following detailed description is, therefore, not to be taken in a limiting sense, and the scope of the present disclosure is defined by the appended claims and their equivalents.

As used herein, an element recited in the singular and proceeded with the word "a" or "an" should be understood as not excluding plural of the elements, unless such exclusion is explicitly stated. Furthermore, references to "an embodiment," "one embodiment," "a representative embodiment," "an exemplary embodiment," "various embodiments," "certain embodiments," and the like are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property.

FIG. 1 is a top elevation view of an exemplary connection hub 1, in accordance with an embodiment of the disclosure. Referring to FIG. 1, the connection hub 1 comprises a connection 2 for button A, a connection 3 for button B, a connection 4 for button C, a connection 5 for a touch pad, a connection 6 for a start device, a connection 7 for a speaker, and a combined connection for a relay judging platform (RJP) with a speed light. Connections 2-7 may be, for example, two-pronged connections. Connection 8 may be a three-pronged connection or any suitable connection.

Figure 2:
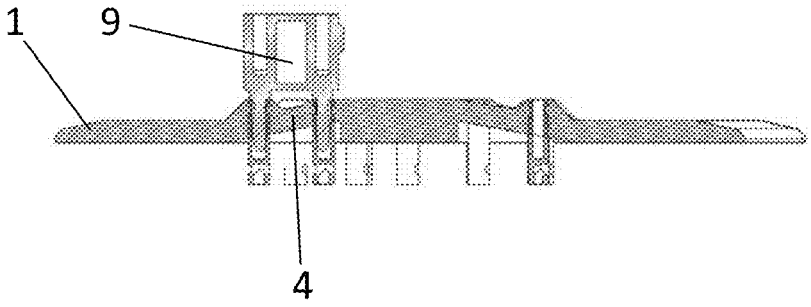
FIG. 2 is a side section view of an exemplary plug inserted into a connection hub, in accordance with an embodiment of the disclosure.

FIG. 2 is a side section view of an exemplary plug 9 inserted into a connection hub 1, in accordance with an embodiment of the disclosure. Referring to FIG. 2, a plug 9 connected to a timing component, such as a button, is inserted in a jack 4 of connection hub 1 corresponding with button C.

Figure 3A:
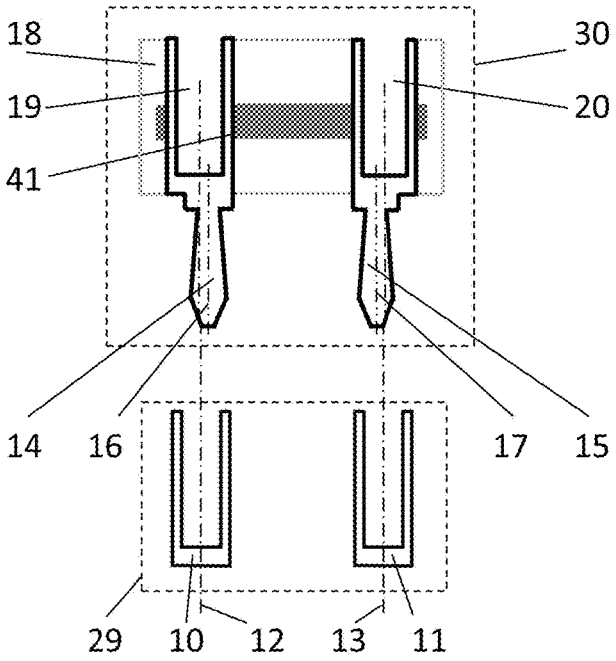
FIG. 3A is a side section view of an exemplary connector having a lower member with two jacks and an upper stackable member including two jacks and two studs, the two studs of the upper stackable member unplugged from the two jacks of the lower member, in accordance with an embodiment of the disclosure.

FIG. 3A is a side section view of an exemplary connector having a lower member 29 with two jacks 10, 11 and an upper stackable member 30 including two jacks 19, 20 and two studs 14, 15, the two studs 14, 15 of the upper stackable member 30 unplugged from the two jacks 10, 11 of the lower member 29, in accordance with an embodiment of the disclosure. Referring to FIG. 3A, the connector comprises an upper stackable member 30 and a lower member 29. The upper stackable member 30, which may share various characteristics with the plug 9 of FIG. 2, comprises a plug body 18, studs 14, 15, and jacks 19, 20. In certain embodiments, the number of studs 14, 15 may not be the same as the number of jacks 19, 20. For example, three studs 14, 15 may fit into a connector 8 while two jacks 19, 20 may receive studs from an additional member 30.

The plug body 18 may be a plastic compound or any suitable material. The plug body 18 may include a body spring 41 configured to contribute to the deformation force of the upper stackable member 30. The body spring 41 may be plastic, metal, or any suitable material. In various embodiments, the combination of stud 14 and jack 19 and/or stud 15 and jack 20 is insulated to prevent a short if the body spring 41 is electrically conducting. The jacks 19, 20 may each comprise an axis aligned with the jack axes 12, 13 of the lower member 29. The jacks 19, 20 may be configured to receive studs of an additional upper stackable member 30 as described below and shown at least, for example, in FIGS. 9A, 9B, and 10. In various embodiments, the jack 19 and stud 14 and the jack 20 and stud 15 may be galvanically connected as shown in FIG. 3A. In certain embodiments, the jack 19 and stud 14 and/or the jack 20 and stud 15 may not be galvanically connected.

The studs 14, 15 of the upper stackable member 30 extend along axes 16, 17 from the plug body 18 to mate with the jacks 10, 11 of the lower member 30 to form a connection. The jacks 19, 20 and/or studs 14, 15 may be connected to a cable by connecting wires as described below with respect to FIG. 13. The cable may connect to and provide communication to and/or from a timing component, such as a button, touch pad, start device, or the like. The lower member 29, which may share various characteristics with the connection hub 1 of FIGS. 1 and 2, may comprise jacks 10, 11, each having an axis 12, 13. As described in more detail below, the axes 12, 13 of the jacks 10, 11 of the lower member are misaligned with the axes 16, 17 of the studs 14, 15 of the upper stackable member 30.

Figure 3B:
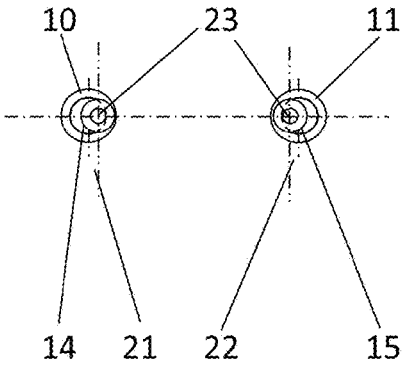
FIG. 3B is an image illustrating a misalignment pattern of the two studs of the upper stackable member and the two jacks of the lower member of FIG. 3A, in accordance with an embodiment of the disclosure.

FIG. 3B is an image illustrating a misalignment pattern of the two studs 14, 15 of the upper stackable member 30 and the two jacks 10, 11 of the lower member 29 of FIG. 3A, in accordance with an embodiment of the disclosure. The tips of the studs 14, 15 of FIG. 3A comprise cones 23, the pattern of which is illustrated in FIG. 3B. FIG. 3B further shows the pattern of the jacks 10, 11 and the misalignment distances 21, 22 between the cones 23 on the tips of the studs 14, 15 and the jacks 10, 11. Additionally and/or alternatively, the openings of the jacks 10, 11 may comprise a chamfer. The distances 21, 22 are overcome by the stud profile and/or the jack profile when the user presses the plug 30 into the jacks 10, 11.

Figure 4A:
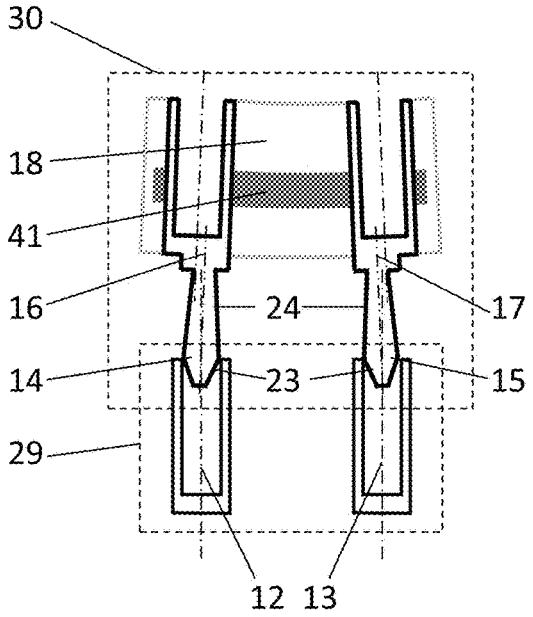
FIG. 4A is a side section view of an exemplary connector having a lower member with two jacks and an upper stackable member including two jacks and two studs, the two studs of the upper stackable member partially plugged into the two jacks of the lower member, in accordance with an embodiment of the disclosure.

FIG. 4A is a side section view of an exemplary connector having a lower member 29 with two jacks 10, 11 and an upper stackable member 30 including two jacks 19, 20 and two studs 14, 15, the two studs 14, 15 of the upper stackable member 30 partially plugged into the two jacks 10, 11 of the lower member 29, in accordance with an embodiment of the disclosure. Referring to FIG. 4A, the two jacks 10, 11 of the lower member 29 have corresponding axes 12, 13. The studs 14, 15 having axes 16, 17 comprise a tip 23 portion, a base portion 24, and a central region 25 between the tip 23 and base 24 portions. The studs 14, 15 have a profile with a width that generally increases from the tip 23 to the central region 25 and generally decreases from the central region 25 to the base 24. For example, the profile of the studs 14, 15 may resemble two cones. The first cone has a narrow portion at the tip 23 of the studs 14, 15 with the wider portion at the central region 25. The second cone has a narrow portion at the base portion 24 towards the plug body 18 with a wider portion at the central region 25. As the cone-shaped profile at the tip 23 of the studs 14, 15 is pressed into the jacks 10, 11, the plug body 18 with the body spring 41 may be adapted to deform, such that the stud axes 16, 17 are not parallel to the jack axes 12, 13. The deformation of the plug body 18 with the body spring 41 creates resultant forces between the studs 14, 15 and jacks 10, 11 when the studs 14, 15 are inserted into the jacks 10, 11. Additionally and/or alternatively, the studs 14, 15 and/or jacks 10, 11 may be adapted to deform as the studs 14, 15 are pressed into the jacks 10, 11.

Figure 4B:
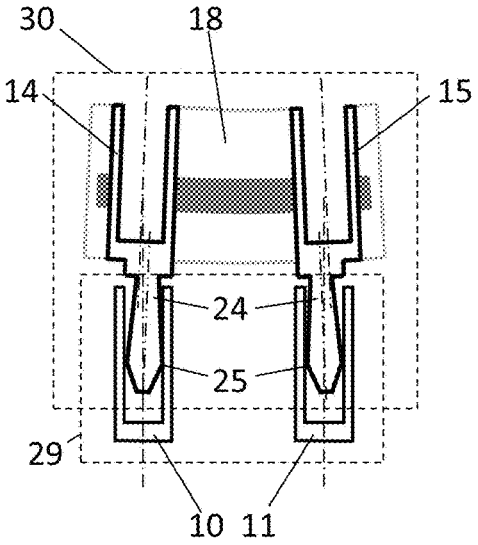
FIG. 4B is a side section view of an exemplary connector having a lower member with two jacks and an upper stackable member including two jacks and two studs, the two studs of the upper stackable member fully plugged into the two jacks of the lower member, in accordance with an embodiment of the disclosure.

FIG. 4B is a side section view of an exemplary connector having a lower member 29 with two jacks 10, 11 and an upper stackable member 30 including two jacks 19, 20 and two studs 14, 15, the two studs 14, 15 of the upper stackable member 30 fully plugged into the two jacks 10, 11 of the lower member 29, in accordance with an embodiment of the disclosure. Referring to FIG. 4B, a plug body 18 and body spring 41 are deformed as the studs 14, 15 are fully plugged into the jacks 10, 11. The cones at the base 24 of the studs 14, 15 limit an amount that the plug body 18 and body spring 41 are deformed. The deformation of the plug body 18 and body spring 41 creates the resultant forces at the central region 25 of the studs 14, 15. The central region 25 is the contact area between the studs 14, 15 and the jacks 10, 11 that create electrical contact.

Figure 5:
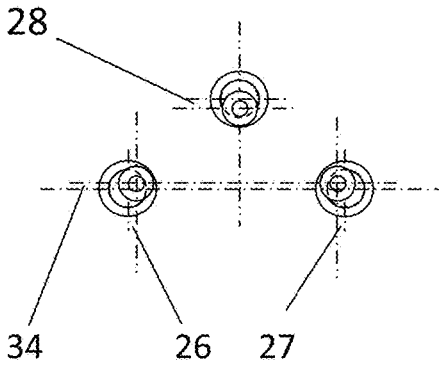
FIG. 5 is an image illustrating a misalignment pattern of an exemplary connector having three studs and three jacks, in accordance with an embodiment of the disclosure.

FIG. 5 is an image illustrating a misalignment pattern of an exemplary connector having three studs and three jacks, in accordance with an embodiment of the disclosure. Referring to FIG. 5, misalignment distances 26-28, 34 that are overcome by deformation when inserting the studs into the jacks, create the resultant forces between the studs and the jacks. In various embodiments, the plugs and jacks of the three-prong connector embodiment of FIG. 5 may share various characteristics with the jacks of connection hub 1 and/or the studs of plug 9 illustrated in FIGS. 1-2 and the studs 14, 15 of upper stackable member 30 and the jacks 10, 11 of lower member 29 illustrated in FIGS. 3A, 4A, and 4B, for example.

Figure 6:
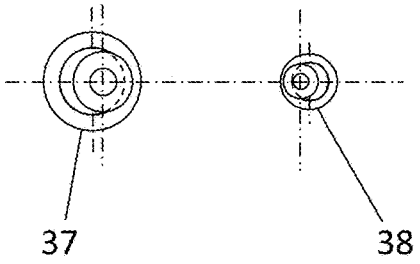
FIG. 6 is an image illustrating a misalignment pattern of an exemplary connector having a large stud, a small stud and a corresponding large jack and small jack, in accordance with an embodiment of the disclosure.

FIG. 6 is an image illustrating a misalignment pattern of an exemplary connector having a large stud, a small stud and a corresponding large jack and small jack, in accordance with an embodiment of the disclosure. Referring to FIG. 6, the diameters of the left stud and jack 37 are larger than the diameters of the right stud and jack 38 to ensure, for example, that the plug is connected with the appropriate polarity. In various embodiments, the different-sized plugs and jacks of the connector embodiment illustrated in FIG. 6 may share various characteristics, for example, with the jacks of connection hub 1 and/or the studs of plug 9 illustrated in FIGS. 1-2 and the studs 14, 15 of upper stackable member 30 and the jacks 10, 11 of lower member 29 illustrated in FIGS. 3A, 4A, and 4B.

Figure 7A:
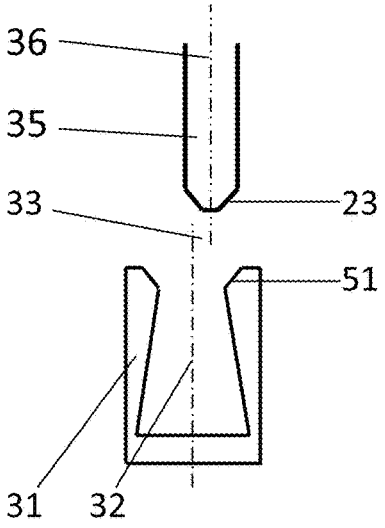
FIG. 7A is a side section view of an exemplary connector having a cylindrical stud unplugged from a jack having non-parallel side walls, in accordance with an embodiment of the disclosure.

FIG. 7A is a side section view of an exemplary connector having a cylindrical stud 35 unplugged from a jack 31 having non-parallel side walls, in accordance with an embodiment of the disclosure. Referring to FIG. 7A, a stud 35 may comprise a vertical axis 36 and a profile having a cylindrical body with a cone-shaped tip. A jack 31 can include an axis 32 and is formed by an opening, a bottom, and non-parallel side walls. In various embodiments, the opening of the jack may include a chamfer 51. Prior to connection of the stud 35 into the jack 31, axes 30, 32 are parallel but misaligned by a distance 33.

Figure 7B:
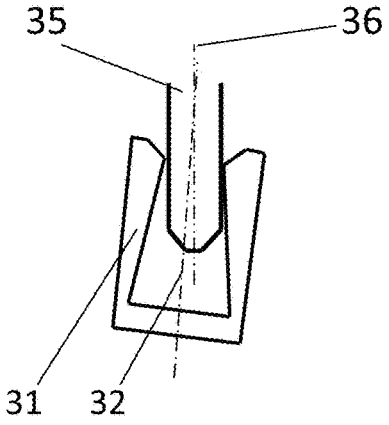
FIG. 7B is a side section view of an exemplary connector having a cylindrical stud partially plugged into a jack having non-parallel side walls, in accordance with an embodiment of the disclosure.

FIG. 7B is a side section view of an exemplary connector having a cylindrical stud 35 partially plugged into a jack 31 having non-parallel side walls, in accordance with an embodiment of the disclosure. Referring to FIG. 7B, the stud 35 of the upper member and the jack 31 of the lower member, as described above in connection with FIG. 7A, are partially plugged together. The misalignment 33 shown in FIG. 7A is overcome in FIG. 7B during the process of plugging the stud 35 into the jack 31 by guiding the tip of the stud 35 via its cone 23 and/or the chamfer 51 of the jack 31 thereby deforming the lower member 29 such that the axis 32 of the jack 31 is tilted, which creates resultant forces between the stud 35 and at least one wall of the jack 31. In the embodiment illustrated in FIG. 7B, the axis 36 of the stud 35 remains vertical. The non-parallel side walls defining a profile of jack 31 ensures that no substantial increase of the tilting of the axes occurs, regardless of the insertion depth of the stud 35. Additionally and/or alternatively, various embodiments provide that the jack 31 and/or the stud 35 may be adapted to deform as the stud 35 is pressed into the jack 31. Although FIGS. 7A and 7B illustrate one stud 35 and one corresponding jack 31, any number of studs 35 and corresponding jacks 31 may be used to form the connection.

Figure 8A:
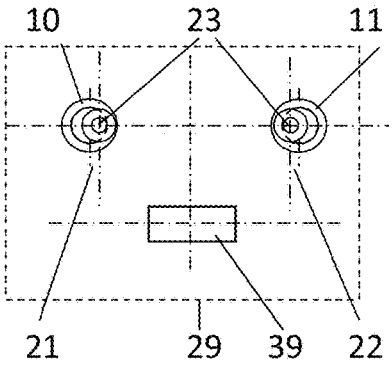
FIG. 8A is an image illustrating a misalignment pattern of two studs and two jacks of an exemplary connector having an upper member with two studs and a mechanical key and a lower member with two jacks and a corresponding key, in accordance with an embodiment of the disclosure.
Figure 8B:
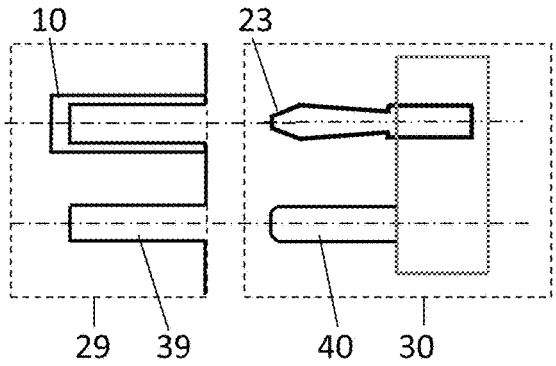
FIG. 8B is a side section view of an exemplary connector having an upper member with two studs and a mechanical key unplugged from a lower member with two jacks and a corresponding key, in accordance with an embodiment of the disclosure.

In certain embodiments, the electrical connector system provides mechanisms to ensure that the electrical connectors are plugged into each other with an appropriate polarity. For example, each of an upper stackable member 30 and lower member 29 of a two pin connector can have one stud 14, 15, 35 and one jack 10, 11, 31 to ensure an appropriate connection. As another example, a connector with five studs 14, 15, 35 and jacks 10, 11, 31 may have four studs 14, 15, 35 and one jack 10, 11, 31 on an upper stackable member 30 and the corresponding four jacks 10, 11, 31 and one stud 14, 15, 35 on a lower member 29 providing only one way to plug the upper 30 and lower 29 members together and ensuring a correct polarity. Further, different diameters of the corresponding stud/plug combinations may be used to provide for connections in the correct polarity. Additionally and/or alternatively, as illustrated in FIGS. 8A and 8B, mechanical keys, such as a male mechanical key 40 on the upper member 30 that fits into a corresponding female mechanical key 39 in the lower member 29 may be provided. FIG. 8A is an image illustrating a misalignment pattern of two studs 14, 15 and two jacks 10, 11 of an exemplary connector having an upper member 30 with two studs 14, 15 and a mechanical key 40 and a lower member 29 with two jacks 10, 11 and a corresponding key 39, in accordance with an embodiment of the disclosure. Specifically, FIG. 8B is a side section view of an exemplary connector having an upper member 30 with two studs 14, 15 and a mechanical key 40 unplugged from a lower member 29 with two jacks 10, 11 and a corresponding key 39, in accordance with an embodiment of the disclosure.

Figure 9A:
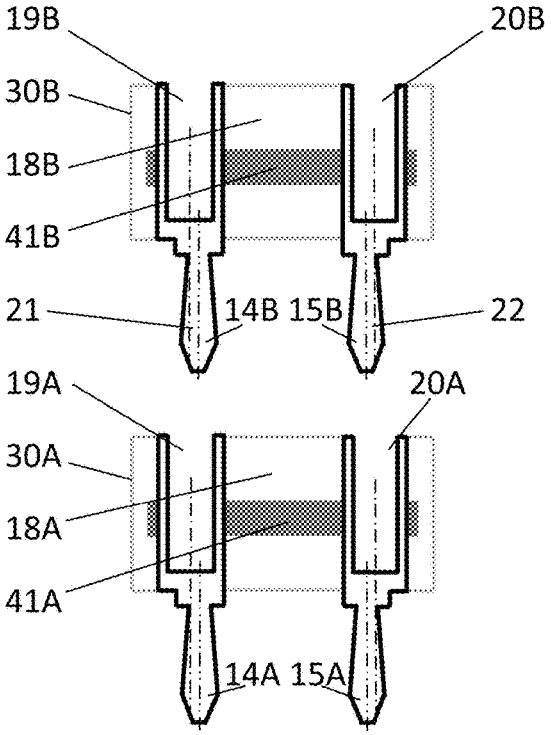
FIG. 9A is a side section view of exemplary upper and lower stackable members each including a body having a body spring, two studs, and two jacks, the two studs of the upper stackable member unplugged from the two jacks of the lower stackable member, in accordance with an embodiment of the disclosure.

FIG. 9A is a side section view of exemplary upper 30B and lower 30A stackable members each including a body 18A, 18B having a body spring 41A, 41B, two studs 14A, 14B, 15A, 15B, and two jacks 19A, 19B, 20A, 20B, the two studs 14B, 15B of the upper stackable member 30B unplugged from the two jacks 19A, 20A of the lower stackable member 30A, in accordance with an embodiment of the disclosure. Referring to FIG. 9A, the upper stackable member 30B and the lower stackable member 30A may include a body 18A, 18B, a body spring 41A, 41B, studs 14A, 14B, 15A, 15B, and jacks 19A, 19B, 20A, 20B. The jacks 19B, 20B of the upper stackable member 30B may be substantially aligned with the jacks 19A, 20A of the lower stackable member 30A. The studs 14B, 15B of the upper stackable member 30B may be substantially aligned with the studs 14A, 15A of the lower stackable member 30A. The jacks 19A, 19B, 20A, 20B of the upper stackable member 30B and the lower stackable member 30A may be misaligned 21, 22 with the studs 14A, 14B, 15A, 15B of the upper stackable member 30B and the lower stackable member 30A. The misalignments 21, 22 between the studs 14A, 14B, 15A, 15B and the jacks 19A, 19B, 20A, 20B may be substantially the same in upper stackable member 30B and lower stackable member 30A.

Figure 9B:
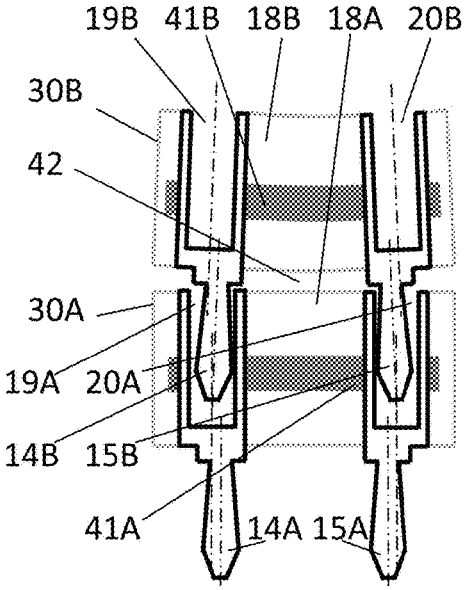
FIG. 9B is a side section view of exemplary upper and lower stackable members each including a body having a body spring, two studs, and two jacks, the body and body spring of the upper stackable member deformed from the two studs of the upper stackable member being plugged into the two jacks of the lower stackable member, in accordance with an embodiment of the disclosure.

FIG. 9B is a side section view of exemplary upper 30B and lower 30A stackable members each including a body 18A, 18B having a body spring 41A, 41B, two studs 14A, 14B, 15A, 15B, and two jacks 19A, 19B, 20A, 20B, the body 18B and body springs 41B of the upper stackable member 30B deformed from the two studs 14B, 15B of the upper stackable member 30B being plugged into the two jacks 19A, 20A of the lower stackable member 30A, in accordance with an embodiment of the disclosure. Referring to FIG. 9B, the misalignments 21 and 22 are overcome by a user inserting the studs 14B, 15B of the upper stackable member 30B into the jacks 19A, 20A of the lower stackable member 30A, which provides a deformation of the upper body 18B and the upper spring 41B. The body 18A and the body spring 41A of the lower stackable member 30A provide a counter bearing for the studs 14B, 15B of the upper stackable member 30B to deform the body 18B and the spring 41B of the upper stackable member 30B, overcoming the misalignments 21 and 22. The deformation results in forces of the studs 14B, 15B of the upper stackable member 30B towards the jacks 19A, 20A of the lower stackable member 30A during insertion to provide electrical contact. Although various embodiments in the drawings and/or description illustrate and/or describe misalignments 21, 22 of the axes 12, 13, 16, 17 that force the tips 23 of the studs 14, 14B, 15, 15B to move apart from each other and/or the jacks 10, 11, 19A, 20A to move closer to each other during insertion, unless so claimed, the scope of the various aspects of the present disclosure should not be limited to the studs 14, 14B, 15, 15B moving apart and/or jacks 10, 11, 19A, 20A moving together and may additionally and/or alternatively be applicable to studs 14, 14B, 15, 15B moving together and/or jacks 10, 11, 19A, 20A moving apart. In certain embodiments, a gap 42 between the upper stackable member 30B and the lower stackable member 30A may be provided to direct water splashed onto the connectors to flow off and reduce a water bridge, thereby reducing electrolysis.

The upper stackable member 30B and the lower stackable member 30A illustrated in FIGS. 9A-9B share various characteristics with the upper stackable member 30 illustrated in FIGS. 3A, 4A, 4B, and 8B as described above.

Figure 10:
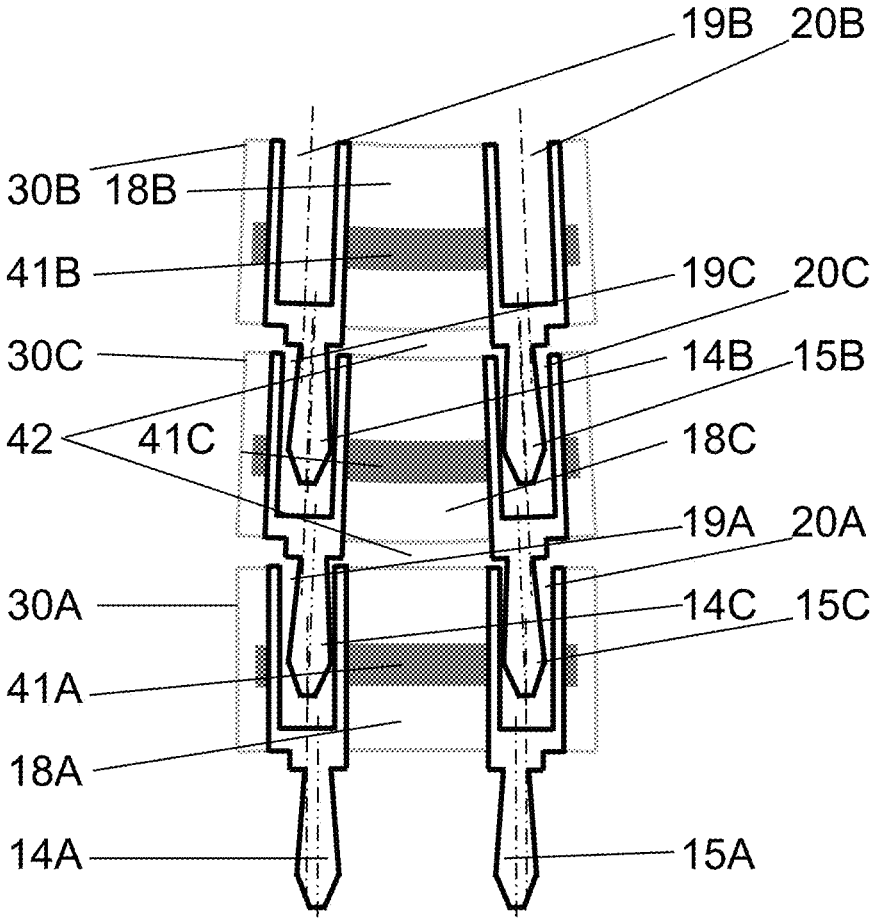
FIG. 10 is a side section view of exemplary upper, lower, and intermediary stackable members each having a body spring, two studs, and two jacks, the body of one or more of the stackable members deformed from plugging in the studs of the upper stackable member into the two jacks of the intermediary stackable member and from plugging in the studs of the intermediary stackable member into the two jacks of the lower stackable member, in accordance with an embodiment of the disclosure.

FIG. 10 is a side section view of exemplary upper 30B, lower 30A, and intermediary 30C stackable members each including a body 18A-C having a body spring 41A-C, two studs 14A-C, 15A-C, and two jacks 19A-C, 20A-C, the body 18B, 18C of one or more of the stackable members 30B, 30C deformed from plugging in the studs 14B, 15B of the upper stackable member 30B into the two jacks 19C, 20C of the intermediary stackable member 30C and from plugging in the studs 14C, 15C of the intermediary stackable member 30C into the two jacks 19A, 20A of the lower stackable member 30A, in accordance with an embodiment of the disclosure. Referring to FIG. 10, the bodies 18B, 18C and body springs 41B, 41C of the upper 30B and intermediary 30C stackable members are shown as being deformed. The deformations provide mechanical contact forces between the corresponding studs 14B, 14C, 15B, 15C and jacks 19A, 19C, 20A, 20C, which in turn provide electrical contact between the corresponding studs 14B, 14C, 15B, 15C and jacks 19A, 19C, 20A, 20C. In various embodiments, the body 18A and body spring 41A of the lower stackable member 30A may be deformed, while still providing deforming forces and thereby electrical contact forces to the intermediary stackable member 30C, if plugged into jacks 19, 20 of another stackable member 30 or jacks 10, 11 of the lower member 29 of FIGS. 3A, 4A, and 4B, for example. Accordingly, a series of any suitable number of stacked members plugged into each other can be created if so desired. The gaps 42 between the upper stackable member 30B, the intermediary stackable member 30C, and the lower stackable member 30A may be provided to direct water splashed onto the connectors to flow off and reduce a water bridge, thereby reducing electrolysis.

The upper stackable member 30B, intermediary stackable member 30C, and lower stackable member 30A illustrated in FIG. 10 shares various characteristics with the upper stackable member 30 illustrated in FIGS. 3A, 4A, 4B, and 8B and the upper stackable member 30B and the lower stackable member 30A illustrated in FIGS. 9A-9B as described above.

Figure 11A:
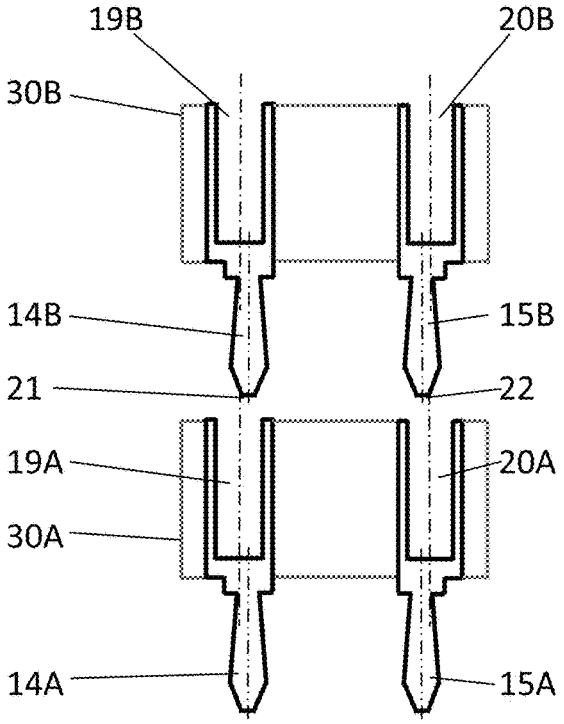
FIG. 11A is a side section view of exemplary upper and lower stackable members each having two studs and two jacks, the two studs of the upper stackable member unplugged from the two jacks of the lower stackable member, in accordance with an embodiment of the disclosure.

FIG. 11A is a side section view of exemplary upper 30B and lower 30A stackable members each having two studs 14A, 14B, 15A, 15B and two jacks 19A, 19B, 20A, 20B, the two studs 14B, 15B of the upper stackable member 30B unplugged from the two jacks 19A, 20A of the lower stackable member 30A, in accordance with an embodiment of the disclosure. Referring to FIG. 11A, the upper stackable member 30B and the lower stackable member 30A may include a body 18A, 18B, studs 14A, 14B, 15A, 15B, and jacks 19A, 19B, 20A, 20B. The jacks 19B, 20B of the upper stackable member 30B may be substantially aligned with the jacks 19A, 20A of the lower stackable member 30A. The studs 14B, 15B of the upper stackable member 30B may be substantially aligned with the studs 14A, 15A of the lower stackable member 30A. The jacks 19A, 19B, 20A, 20B of the upper stackable member 30B and the lower stackable member 30A may be misaligned 21, 22 with the studs 14A, 14B, 15A, 15B of the upper stackable member 30B and the lower stackable member 30A. The misalignments 21 and 22 between the studs 14A, 14B, 15A, 15B and the jacks 19A, 19B, 20A, 20B may be substantially the same in upper stackable member 30B and lower stackable member 30A.

Figure 11B:
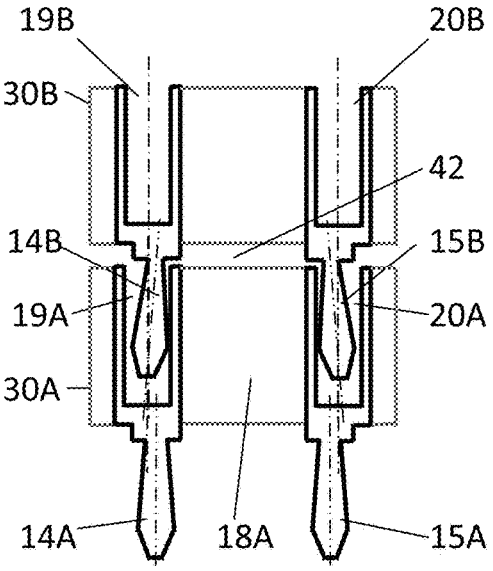
FIG. 11B is a side section view of exemplary upper and lower stackable members each having two studs and two jacks, the studs of the upper stackable member deformed from being plugged into the two jacks of the lower stackable member, in accordance with an embodiment of the disclosure.

FIG. 11B is a side section view of exemplary upper 30B and lower 30A stackable members each having two studs 14A, 14B, 15A, 15B and two jacks 19A, 19B, 20A, 20B, the 14B, 15B of the upper stackable member 30B deformed from being plugged into the two jacks 19A, 20A of the lower stackable member 30A, in accordance with an embodiment of the disclosure. Referring to FIG. 11B, the misalignments 21 and 22 are overcome by a user inserting the studs 14B, 15B of the upper stackable member 30B into the jacks 19A, 20A of the lower stackable member 30A, which provides a deformation of the studs 14B, 15B. The jacks 19A, 20A and body 18A of the lower stackable member 30A provide a counter bearing for the studs 14B, 15B of the upper stackable member 30B to deform the studs 14B, 15B of the upper stackable member 30B and thereby overcome the misalignments 21 and 22. The deformation results in forces of the studs 14B, 15B of the upper stackable member 30B towards the jacks 19A, 20A of the lower stackable member 30A during insertion to provide electrical contact. In certain embodiments, a gap 42 between the upper stackable member 30B and the lower stackable member 30A may be provided to direct water splashed onto the connectors to flow off and reduce a water bridge, thereby reducing electrolysis.

The upper stackable member 30B and the lower stackable member 30A illustrated in FIGS. 11A-11B shares various characteristics with the upper stackable member 30 illustrated in FIGS. 3A, 4A, 4B, and 8B and the upper stackable member 30B and the lower stackable member 30A illustrated in FIGS. 9A, 9B, and 10 as described above.

Figure 12:
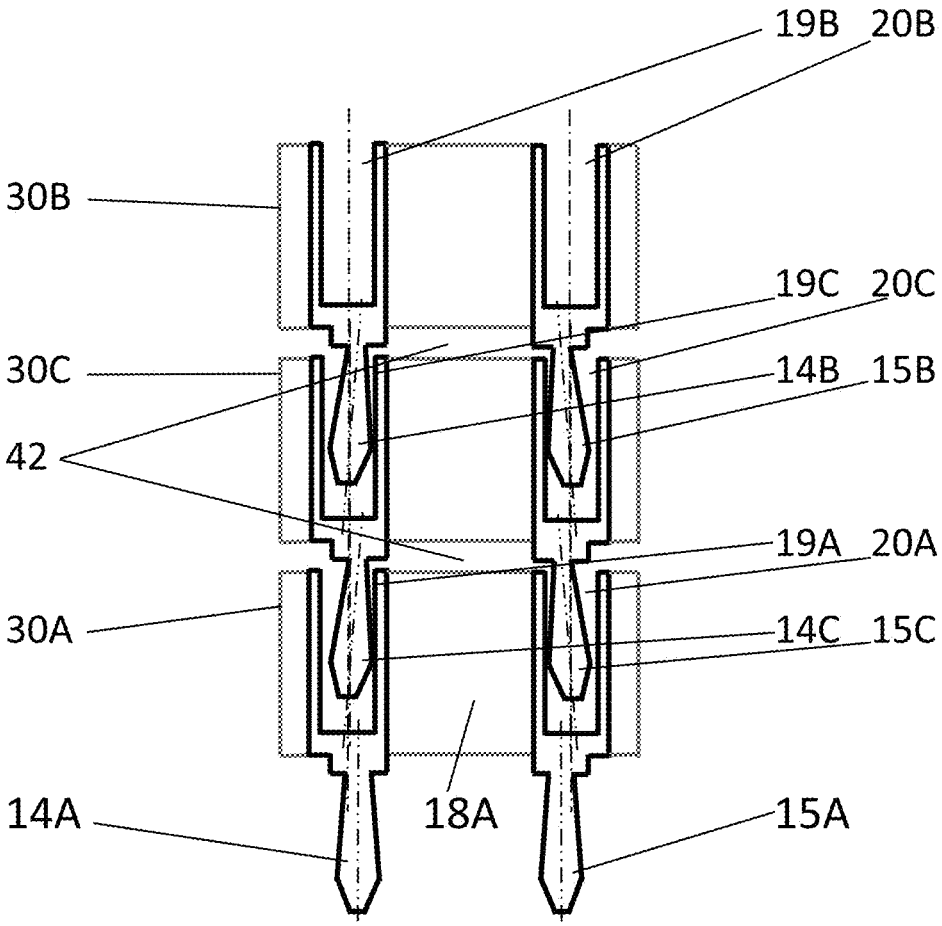
FIG. 12 is a side section view of exemplary upper, lower, and intermediary stackable members each having two studs and two jacks, the studs of the upper stackable member deformed from being plugged into the two jacks of the intermediary stackable member, and the studs of the intermediary stackable member deformed from being plugged into the two jacks of the lower stackable member, in accordance with an embodiment of the disclosure.

FIG. 12 is a side section view of exemplary upper 30B, lower 30A, and intermediary 30C stackable members each having two studs 14A-C, 15A-C and two jacks 19A-C, 20A-C, the studs 14B, 15B of the upper stackable member 30B deformed from being plugged into the two jacks 19C, 20C of the intermediary stackable member 30C, and the studs 14C, 15C of the intermediary stackable member 30C deformed from being plugged into the two jacks 19A, 20A of the lower stackable member 30A, in accordance with an embodiment of the disclosure.

Referring to FIG. 12, the studs 14B, 14C, 15B, 15C of the upper 30B and intermediary 30C stackable members are shown as being deformed. The deformations provide mechanical contact forces between the corresponding studs 14B, 14C, 15B, 15C and jacks 19A, 19C, 20A, 20C, which in turn provide electrical contact between the corresponding studs 14B, 14C, 15B, 15C and jacks 19A, 19C, 20A, 20C. In various embodiments, the studs 14A, 15A of the lower stackable member 30A may be deformed, while the body 18A of the lower stackable member 30A is still providing deforming forces and thereby electrical contact forces to the intermediary stackable member 30C, if plugged into jacks 19, 20 of another stackable member 30 or jacks 10, 11 of the lower member 29 of FIGS. 3A, 4A, and 4B, for example. Accordingly, a series of any suitable number of stacked members plugged into each other can be created if so desired. The gaps 42 between the upper stackable member 30B, the intermediary stackable member 30C, and the lower stackable member 30A may be provided to direct water splashed onto the connectors to flow off and reduce a water bridge, thereby reducing electrolysis.

The upper stackable member 30B, intermediary stackable member 30C, and lower stackable member 30A illustrated in FIG. 12 share various characteristics with the upper stackable member 30 illustrated in FIGS. 3A, 4A, 4B, and 8B, the upper stackable member 30B and the lower stackable member 30A illustrated in FIGS. 9A-9B and 11A-11B, and the upper stackable member 30B, intermediary stackable member 30C, and lower stackable member 30A illustrated in FIG. 10 as described above.

Figure 13:
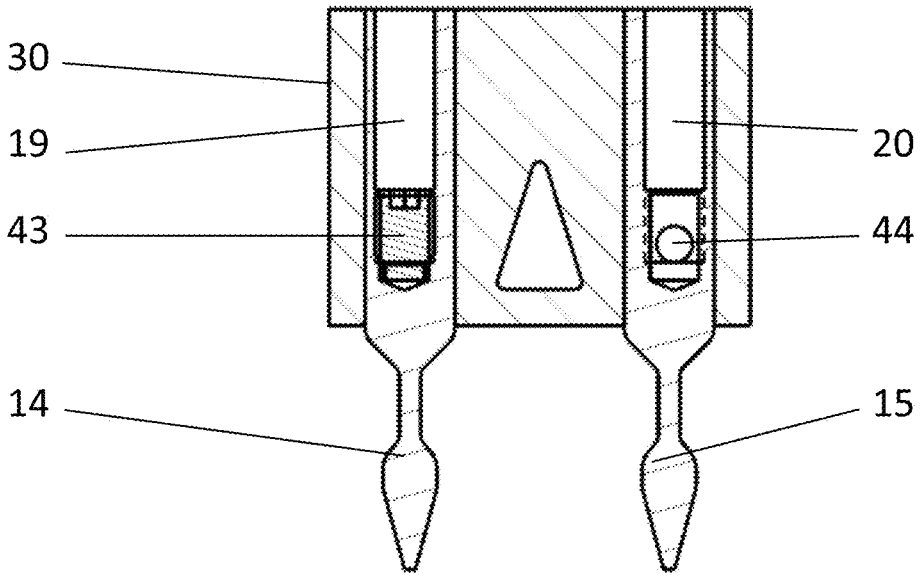
FIG. 13 is a side section view of an exemplary stackable member with two studs, two jacks, an opening, and a set screw, the opening configured to receive the insertion of a connecting wire and the set screw configured to secure the connecting wire in the opening, in accordance with an embodiment of the disclosure.

FIG. 13 is a side section view of an exemplary stackable member 30 with two studs 14, 15, two jacks 19, 20, an opening 44, and a set screw 43, the opening 44 configured to receive the insertion of a connecting wire (not shown) and the set screw 43 configured to secure the connecting wire in the opening 44, in accordance with an embodiment of the disclosure. Referring to FIG. 13, at least one connecting wire may be inserted through the opening 44 and affixed in place with the set screw 43 to provide a stable connection between the at least one wire and the jack 19, 20 and stud 14, 15. The connecting wires may be connected to a cable (not shown) to provide communication to and/or from a timing component, such as a button, touch pad, start device, or the like.

The stackable member 30 illustrated in FIG. 13 shares various characteristics with the upper stackable member 30 illustrated in FIGS. 3A, 4A, 4B, and 8B, the upper stackable member 30B and the lower stackable member 30A illustrated in FIGS. 9A-9B and 11A-11B, and the upper stackable member 30B, intermediary stackable member 30C, and lower stackable member 30A illustrated in FIGS. 10 and 12 as described above.

Figure 14A:
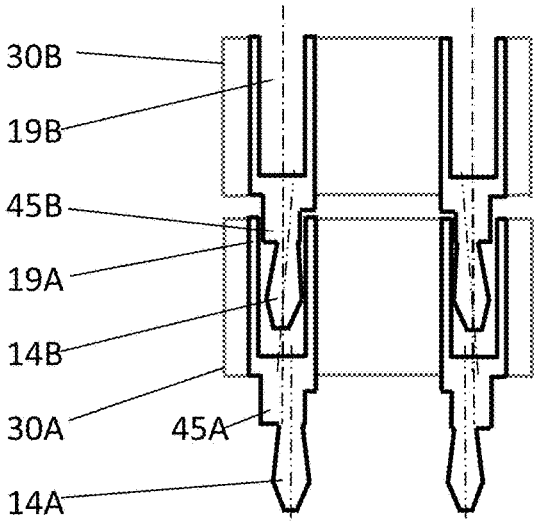
FIG. 14A is a side section view of exemplary upper and lower stackable members each having two studs and two jacks, a top portion of each of the studs of the upper stackable member having a locking feature configured to fit into a top portion of the jacks of the lower stackable member when substantially plugged in to reduce movement of the upper stackable member relative to the lower stackable member, in accordance with an embodiment of the disclosure.
Figure 14B:
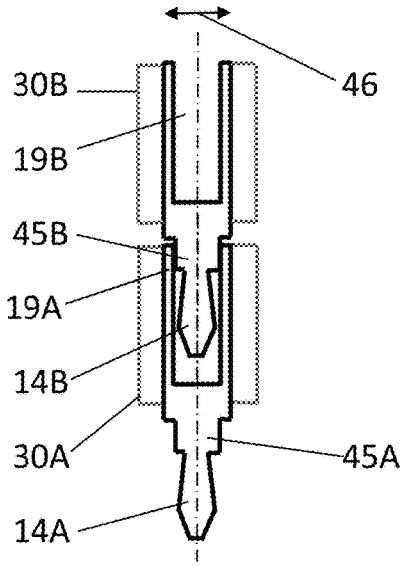
FIG. 14B is a side section view perpendicular to FIG. 14A of exemplary upper and lower stackable members each having two studs and two jacks, a top portion of each of the studs of the upper stackable member having a locking feature configured to fit into a top portion of the jacks of the lower stackable member when substantially plugged in to reduce movement of the upper stackable member relative to the lower stackable member, in accordance with an embodiment of the disclosure.

FIG. 14A is a side section view and FIG. 14B is a side section view perpendicular to FIG. 14A of exemplary upper 30B and lower 30A stackable members each having two studs 14A, 14B, 15A, 15B and two jacks 19A, 19B, 20A, 20B, a top portion of each of the studs 14B, 15B of the upper stackable member 30B having a locking feature 45B configured to fit into a top portion of the jacks 19A, 20A of the lower stackable member 30A when substantially plugged in to reduce movement 46 of the upper stackable member 30B relative to the lower stackable member 30A, in accordance with an embodiment of the disclosure. Referring to FIGS. 14A and 14B, a locking feature 45A, 45B at the top of the studs 14A, 14B, 15A, 15B may be provided that substantially fits into the top of the jacks 19A, 19B, 20A, 20B. The locking feature 45B may be thicker than the adjacent base portion 24 of the studs 14A, 14B, 15A, 15B while substantially fitting into the top of the jacks 19A, 19B, 20A, 20B, thereby reducing the possible movement 46. In the case of the studs 14A, 15A of member 30A being plugged into another member, the locking feature 45A may lock in as described above.

The upper 30B and lower 30A stackable members illustrated in FIGS. 14A-14B share various characteristics with the upper stackable member 30 illustrated in FIGS. 3A, 4A, 4B, and 8B, the upper stackable member 30B and the lower stackable member 30A illustrated in FIGS. 9A-9B and 11A-11B, the upper stackable member 30B, intermediary stackable member 30C, and lower stackable member 30A illustrated in FIGS. 10 and 12, and the stackable member 30 illustrated in FIG. 13 as described above.

Figure 15A:
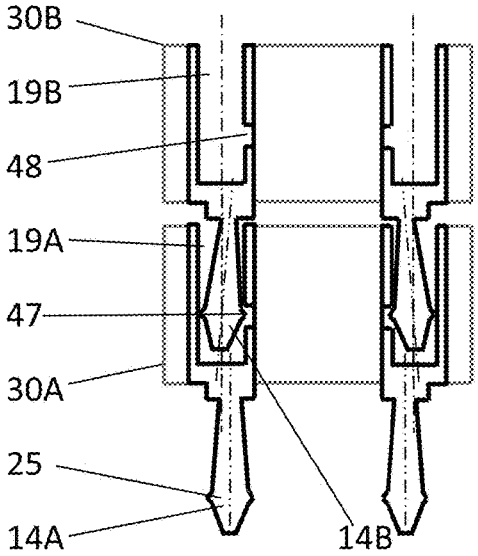
FIG. 15A is a side section view of exemplary upper and lower stackable members each having two studs and two jacks, a central portion of each of the studs of the upper stackable member having a widening feature configured to fit into a corresponding widening feature in the jacks of the lower stackable member when substantially plugged in to increase a holding force of the upper stackable member relative to the lower stackable member at the depth of the widening features, in accordance with an embodiment of the disclosure.

FIG. 15A is a side section view of exemplary upper 30B and lower 30A stackable members each having two studs 14A, 14B, 15A, 15B and two jacks 19A, 19B, 20A, 20B, a central portion 25 of each of the studs 14B, 15B of the upper stackable member 30B having a widening feature 47 configured to fit into a corresponding widening feature 48 in the jacks 19A, 20A of the lower stackable member 30A when substantially plugged in to increase a holding force of the upper stackable member 30B relative to the lower stackable member 30A at the depth of the widening features 47, 48, in accordance with an embodiment of the disclosure. In various embodiments the widening feature 47 of the studs 14B, 15B may be omitted and the function of the increase of the holding force may be performed by the central region 25 of the studs 14B, 15B substantially fitting into the widening feature 48 in the jacks 19A, 20A. The widening feature(s) 47, 48 may provide additional holding force to prevent inadvertent removal of the upper stackable member 30B from the lower stackable member 30A, for example, by a user bumping the stackable members 30A, 30B. In certain embodiments, the widening feature(s) 47, 48 may provide tactile feedback to a user that an appropriate plug depth has been achieved when the widening features 47, 48 fit together or when the central region 25 of the studs 14B, 15B fits into the widening feature 48 of the jacks 19A, 20A.

Figure 15B:
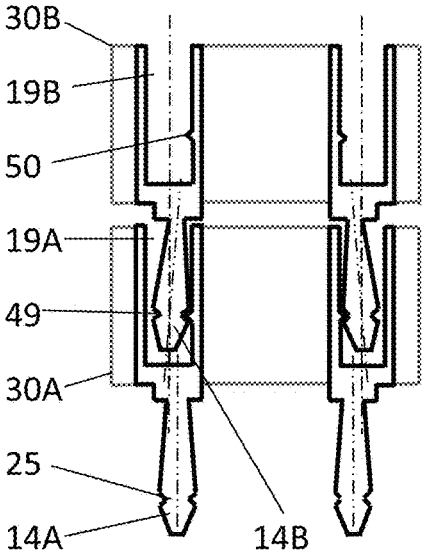
FIG. 15B is a side section view of exemplary upper and lower stackable members each having two studs and two jacks, each of the jack of the lower stackable member including a narrowing feature configured to fit into a corresponding narrowing feature in a central portion of each of the studs of the upper stackable member when substantially plugged in to increase a holding force of the upper stackable member relative to the lower stackable member at the depth of the narrowing features, in accordance with an embodiment of the disclosure.

FIG. 15B is a side section view of exemplary upper 30B and lower 30A stackable members each having two studs 14A, 14B, 15A, 15B and two jacks 19A, 19B, 20A, 20B, each of the jacks 19A, 20A of the lower stackable member 30A including a narrowing feature 50 configured to fit into a corresponding narrowing feature 49 in a central portion 25 of each of the studs 14B, 15B of the upper stackable member 30B when substantially plugged in to increase a holding force of the upper stackable member 30B relative to the lower stackable member 30A at the depth of the narrowing features 49, 50, in accordance with an embodiment of the disclosure. In various embodiments, the narrowing feature 49 of the studs 14B, 15B may be omitted and the function of the increase of the holding force may be performed by the central region 25 of the studs 14B, 15B extending beyond a narrowing feature 50 in the jacks 19A, 20A. The narrowing feature(s) 49, 50 may provide additional holding force to prevent inadvertent removal of the upper stackable member 30B from the lower stackable member 30A, for example, by a user bumping the stackable members 30A, 30B. In certain embodiments, the narrowing feature(s) 49, 50 may provide tactile feedback to a user that an appropriate plug depth has been achieved when the narrowing features 49, 50 fit together or when the central region 25 of the studs 14B, 15B extends beyond the narrowing feature 50 of the jacks 19A, 20A.

The upper 30B and lower 30A stackable members illustrated in FIGS. 15A-15B share various characteristics with the upper stackable member 30 illustrated in FIGS. 3A, 4A, 4B, and 8B, the upper stackable member 30B and the lower stackable member 30A illustrated in FIGS. 9A-9B, 11A-11B, and 15A-15B, the upper stackable member 30B, intermediary stackable member 30C, and lower stackable member 30A illustrated in FIGS. 10 and 12, and the stackable member 30 illustrated in FIG. 13 as described above.

Aspects of the present disclosure provide studs 14, 15 intentionally misaligned with respective jacks 10, 11, 19, 20. The intentionally misaligned studs 14, 15 and jacks 10, 11, 19, 20 eliminate the need for conventional spring members for providing resultant forces between the studs 14, 15 and the jacks 10, 11, 19, 20. Instead, the misalignment causes the plug body 18, the body spring 41, the studs 14, 15, the jacks 10, 11, 19, 20 and/or the lower member 29 to deform and provide the resultant force. More specifically, studs 14, 15 and jacks 19, 20 may be integrated into an upper stackable connector member 30 and jacks 10, 11 may be integrated into a lower connector member 29. The misalignment of the studs 14, 15 and jacks 10, 11 of the upper 30 and lower 29 connector members creates deformation in the overall connector 29, 30 once plugged in, thereby creating resultant forces that press the studs 14, 15 against the walls of the jacks 10, 11. Additionally and/or alternatively, the misalignment of the studs 14, 15 and jacks 19, 20 of the upper stackable 30B and lower stackable 30A connector members creates deformation in the overall connector 30A, 30B once plugged in, thereby creating resultant forces that press the studs 14, 15 against the walls of the jacks 19, 20. The resultant forces create electrical contact between the studs 14, 15 and jacks 10, 11, 19, 20. The forces keep the contact over initial mechanical tolerances and abrasion tolerances over time. The resultant forces further withstand mechanical forces on the plug 30, such as a user bumping the plug 30. In various embodiments, the studs 14, 15 and jacks 10, 11, 19, 20 are solid metal parts allowing manufacture from corrosion resistant materials such as titanium, high performance alloys from the Hastelloy Cr group, alloys from the austenitic nickel-chromium based superalloys such as Inconel 625, and other suitable corrosion resistant materials.

The misalignment of the studs 14, 15, 35 and jacks 10, 11, 19, 20, 31 is illustrated by the offset 21, 22, 26-28, 33 between the stud axes 16, 17, 36 and the jack axes 12, 13, 32. The misalignment causes deformation in the plug body 18, the body spring 41, the studs 14, 15, 35, the jacks 10, 11, 19, 20, 31, and/or lower member 29 when the studs 14, 15, 35 are inserted into the jacks 10, 11, 19, 20, 31. The deformation during insertion, as illustrated in FIGS. 4A, 4B, 7B, 9B, 10, 11B, 12, 14A, 15A, and 15B, for example, results in the axes 12, 13, 16, 17, 32, 36 of a stud 14, 15, 35 and a corresponding jack 10, 11, 31 to no longer be parallel. To limit the angle between the axes 12, 13, 16, 17, 32, 36 the deeper the studs 14, 15, 35 are inserted, an exemplary embodiment provides that one or more of the stud 14, 15, 35 and the jack 10, 11, 31 comprises a profile that creates a constant deformation over the length of the path that the stud 14, 15, 35 is inserted into the jack 10, 11, 31, resulting in a constant deformation force. For example, the profile may provide the initial deformation at the beginning of the insertion process by having cone-shaped tips of the studs 14, 15, 35 and/or chamfered openings 51 of the jacks 31.

To overcome the misalignment 33 of the axes 12, 13, 32 of the jacks 10, 11, 31 and the axes 16, 17, 36 of the studs 14, 15, 35, cone-shaped stud tips 23 and/or chamfers 51 of jacks 31 slidably guide the studs 14, 15, 35 into the jacks 10, 11, 31, while deforming a plug body 18, the body spring 41, the studs 14, 15, 35, the jacks 10, 11, 31, and/or lower member 29 body. As the studs 14, 15, 35 are slid into jacks 10, 11, 31, an angle between the stud axes 16, 17, 36 and the jack axes 12, 13, 32 increases. The angle may be limited by, for example, decreasing a profile from a central portion 25 to a base 24 of the studs 14, 15, 35 such that the thickest central portion 25 provides the electrical contact of the studs 14, 15, 35 to the walls of the jacks 10, 11, 31.

In various embodiments, the profile of the stud 14, 15, 35 may be shaped similar to two cones connected at a thickest portion. The thickest central portion 25 of the cones provides the contact area of the stud 14, 15, 35 that touches the inside of the jack 10, 11, 31. The contact area 25 can have several geometries, such as, for example, a curve between the two cones, a sphere, rounded, sharp, or an additional cone (e.g., the stud wall parallel with the jack walls when plugged in and thus deformed). The contact area may be thicker than the bases of the cones to counteract abrasion over long periods of time.

In certain embodiments, the profile of the jack 10, 11, 31 may be cone-shaped with a narrowest portion at the jack opening and the widest portion at the jack end. For example, a stud 35 inserted into a cone-shaped jack 31 may cause a lower member 29 body to deform, creating an angle in the jack axes 12, 13, 32 relative to the stud axes 16, 17, 36, and producing resultant forces. The wider portion toward the jack end allows the narrower portion at the jack opening to have contact with the walls of the studs, as shown in FIG. 7B, for example. Consequently, the angle between the stud and jack axes 12, 13, 16, 17, 32, 36 may remain constant as the stud 14, 15, 35 is inserted deeper into the jack 10, 11, 31.

Aspects of the present disclosure provide substantial deformations in both upper 30, 30B and lower 29, 30A connector members using corresponding profiles in studs 14, 15, 35 and jacks 10, 11, 31. For example, both stud and jack profiles may work together to provide the initial deformation and then provide that the angle between the axes 12, 13, 16, 17, 32, 36 does not change further along the insertion path.

In various embodiments, one or more of the studs 14, 15, 35 may not be electrically conducting. For example, some of the studs 14, 15, 35 of a connector can be part of an electrical connection and some can just provide a counter bearing to create the desired resultant deformation forces for the electrical connections in the corresponding jacks 10, 11, 31.

The upper 30, 30B and lower 29, 30A members may each comprise a body 18 for jacks 10, 11, 31 and studs 14, 15, 35. The body 18 may be plastic or any suitable material for allowing deformation to provide the resultant forces of the studs 14, 15, 35 against the jacks 10, 11, 31. For example, the softer the body material, the lower the resultant forces. Consequently, a ratio between the softness of the body material and the value of the misalignment may be balanced to obtain the desired resultant forces. In various embodiments, the body 18 may include a body spring 41 to provide resultant forces of the studs 14, 15, 35 against the jacks 10, 11, 31. Consequently, a ratio between the softness of the body material and the body spring 41 and the value of the misalignment may be balanced to obtain the desired resultant forces. The overall plug pattern geometry may also contribute to ensuring that sufficient resultant forces are provided. For example, an eight stud connector can be arranged in a circle, misaligned to the eight jack pattern that is arranged in a smaller circle, to create similar resultant forces for each stud.

Various embodiments provide that studs 14, 15, 35 and/or jacks 10, 11, 31 can be slotted to create prongs that provide a spring effect that adds to a resultant force for each stud 14, 15, 35. For example, a diameter of a stud 14, 15, 35 may be larger than the corresponding opening diameter of a jack 10, 11, 31. The cone at the tip 23 of a stud 14, 15, 35 that has been slotted to form prongs may be compressed during insertion of the pronged studs 14, 15, 35 into the jacks 10, 11, 31. The spring effect of the compressed prongs creates a resultant force for the electrical contact. As another example, the cone at the tip 23 of a stud having a diameter that is larger than the corresponding opening diameter of a slotted jack may force prongs of the slotted jack to expand during stud insertion, which provides a resultant force for the electrical contact. The slotting of the studs 14, 15, 35 and/or jacks 10, 11, 31 may be used in addition to and/or as an alternative to misaligning the studs 14, 15, 35 and jacks 10, 11, 31.

In accordance with various embodiments, a stackable connector system is provided. The stackable connector system comprises an upper member 30, 30A-C and a lower member 29, 30A, 30C. The upper member 30, 30A-C comprises an upper member body 18, 18A-C holding a first set of upper connections 19, 19A-C, 20, 20A-C and a second set of upper connections 14, 14A-C, 15, 15A-C, 35. The first set of upper connections 19, 19A-C, 20, 20A-C comprises at least one of a plurality of studs and a plurality of jacks. The second set of upper connections 14, 14A-C, 15, 15A-C, 35 comprises at least one of the plurality of studs and the plurality of jacks that are opposite with the first set of upper connections 19, 19A-C, 20, 20A-C. The lower member 29, 30A, 30C comprises a lower member body 18A, 18C holding a first set of lower connections 10, 11, 19A, 19C, 20A, 20C, 31 comprising at least one of the plurality of studs and the plurality of jacks that are opposite and correspond with the second set of upper connections 14, 14A-C, 15, 15A-C, 35. The second set of upper connections 14, 14A-C, 15, 15A-C, 35 and the first set of lower connections 10, 11, 19A, 19C, 20A, 20C, 31 have parallel axes 12, 13, 16, 17, 32, 36 that are misaligned 21, 22, 26, 27 in an unplugged state. The misalignment 21, 22, 26, 27 creates deformation of at least one of the upper member 30, 30A-C and the lower member 29, 30A, 30C during insertion of the plurality of studs into the plurality of jacks when the second set of upper connections 14, 14A-C, 15, 15A-C, 35 and the first set of lower connections 10, 11, 19A, 19C, 20A, 20C, 31 are plugged together. The deformation creates a resultant force between the second set of upper connections 14, 14A-C, 15, 15A-C, 35 and the first set of lower connections 10, 11, 19A, 19C, 20A, 20C, 31.

In a representative embodiment, the lower member body 18A, 18C holds a second set of lower connections 14A, 14C, 15A, 15C, 35 comprising at least one of the plurality of studs and the plurality of jacks that are opposite with the first set of lower connections 10, 11, 19A, 19C, 20A, 20C, 31. In an exemplary embodiment, the second set of lower connections 14A, 14C, 15A, 15C, 35 is substantially aligned with the second set of upper connections 14, 14A-C, 15, 15A-C, 35. In certain embodiments, the first set of upper connections 19, 19A-C, 20, 20A-C and the first set of lower connections 10, 11, 19A, 19C, 20A, 20C, 31 have parallel axes that are substantially aligned.

In various embodiments, the upper member body 18, 18A-C comprises a body spring 41, 41A-C. The misalignment 21, 22, 26, 27 creates deformation of the upper member body 18, 18A-C and the body spring 41, 41A-C during insertion of the plurality of studs 14, 14A-C, 15, 15A-C, 35 into the plurality of jacks 10, 11, 19A, 19C, 20A, 20C, 31. The deformation of the upper member body 18, 18A-C and the body spring 41, 41A-C contributes to the resultant force. In a representative embodiment, the misalignment 21, 22, 26, 27 creates deformation of the second set of upper connections 14, 14A-C, 15, 15A-C, 35 during insertion of the plurality of studs 14, 14A-C, 15, 15A-C, 35 into the plurality of jacks 10, 11, 19A, 19C, 20A, 20C, 31. The deformation of the second set of upper connections 14, 14A-C, 15, 15A-C, 35 contributes to the resultant force. In an exemplary embodiment, each of the plurality of studs 14, 14A-C, 15, 15A-C, 35 of the upper member 30, 30A-C is galvanically connected to a different one of the plurality of jacks 19, 19A-C, 20, 20A-C of the upper member 30, 30A-C.

In certain embodiments, the stackable connector system comprises an additional member 30B, 30C comprising an additional member body 18B, 18C holding a first set of additional connections 14B, 14C, 15B, 15C, 35 comprising at least one of the plurality of studs and the plurality of jacks that are opposite and correspond with the first set of upper connections 19, 19A-C, 20, 20A-C, 31. The first set of upper connections 19, 19A-C, 20, 20A-C, 31 and the first set of additional connections 14B, 14C, 15B, 15C, 35 have parallel axes 12, 13, 16, 17, 32, 36 that are misaligned 21, 22, 26, 27 in an unplugged state. The misalignment 21, 22, 26, 27 creates deformation of at least one of the upper member 30, 30A-C and the additional member 30B, 30C during insertion of the plurality of studs into the plurality of jacks when the first set of upper connections 19, 19A-C, 20, 20A-C, 31 and the first set of additional connections 14B, 14C, 15B, 15C, 35 are plugged together. The deformation creates a resultant force between the first set of upper connections 19, 19A-C, 20, 20A-C, 31 and the first set of additional connections 14B, 14C, 15B, 15C, 35.

In an exemplary embodiment, the stackable connector system comprises an additional member 29, 30A comprising an additional member body 18A holding a first set of additional connections 10, 11, 19A, 20A, 31 comprising at least one of the plurality of studs and the plurality of jacks that are opposite and correspond with the second set of lower connections 14A, 14C, 15A, 15C, 35. The first set of additional connections 10, 11, 19A, 20A, 31 and the second set of lower connections 14A, 14C, 15A, 15C, 35 have parallel axes 12, 13, 16, 17, 32, 36 that are misaligned 21, 22, 26, 27 in an unplugged state. The misalignment 21, 22, 26, 27 creates deformation of at least one of the lower member 29, 30A, 30C and the additional member 29, 30A during insertion of the plurality of studs into the plurality of jacks when the second set of lower connections 14A, 14C, 15A, 15C, 35 and the first set of additional connections 10, 11, 19A, 20A, 31 are plugged together. The deformation creates a resultant force between the second set of lower connections 14A, 14C, 15A, 15C, 35 and the first set of additional connections 10, 11, 19A, 20A, 31.

In a representative embodiment, the stackable connector system comprises a gap 42 between the upper member body 18, 18A-C and the lower member body 18A, 18C when the second set of upper connections 14, 14A-C, 15, 15A-C, 35 and the first set of lower connections 10, 11, 19A, 19C, 20A, 20C, 31 are fully plugged together. In an exemplary embodiment, the upper member 30, 30A-C comprises an opening 44 configured to receive a connecting wire. The upper member 30, 30A-C comprises an attachment mechanism 43 configured to secure the connecting wire in the opening 44 to electrically connect the connecting wire to one or both of one connection from the first set of upper connections 19, 19A-C, 20, 20A-C, 31 and one connection from the second set of upper connections 14, 14A-C, 15, 15A-C, 35.

In certain embodiments, each of the plurality of jacks 10, 11, 19, 19A-C, 20, 20A-C comprises a jack widening feature 48 or a jack narrowing feature 50. In various embodiments, each of the plurality of studs 14, 14A-C, 15, 15A-C comprises a stud widening feature 47 that fits into the jack widening feature 48 or a stud narrowing feature 49 that fits into the jack narrowing feature 50. In a representative embodiment, each of the plurality of studs 14, 14A-C, 15, 15A-C comprises a central region 25 configured to fit into the jack widening feature 48 and extend beyond a jack narrowing feature 50.

In various embodiments, each of the plurality of studs 14, 14A-C, 15, 15A-C comprises a locking feature 45B at a top of each of the plurality of the studs 14, 14A-C, 15, 15A-C. The locking feature 45B is configured to fit into a top of each of the plurality of jacks 10, 11, 19, 19A-C, 20, 20A-C. In an exemplary embodiment, the locking feature 45B has a thickness greater than a thickness of an adjacent base portion 24 of each of the plurality of studs 14, 14A-C, 15, 15A-C. In a representative embodiment, a number of the at least one of the plurality of studs and the plurality of jacks of the first set of upper connections 19, 19A-C, 20, 20A-C is unequal to a number of the at least one of the plurality of studs and the plurality of jacks of the second set of upper connections 14, 14A-C, 15, 15A-C, 35.

As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g." and "for example" set off lists of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled, or not enabled, by some user-configurable setting.

Although devices, methods, and systems according to the present disclosure may have been described in connection with a preferred embodiment, it is not intended to be limited to the specific form set forth herein, but on the contrary, it is intended to cover such alternative, modifications, and equivalents, as can be reasonably included within the scope of the disclosure as defined by this description and appended diagrams.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What is claimed is:

1. A stackable connector system comprising:

an upper member comprising an upper member body holding a first set of upper connections and a second set of upper connections, the first set of upper connections comprising at least one of a plurality of studs and a plurality of jacks, the second set of upper connections comprising at least one of the plurality of studs and the plurality of jacks that are opposite with the first set of upper connections; and a lower member comprising a lower member body holding a first set of lower connections comprising at least one of the plurality of studs and the plurality of jacks that are opposite and correspond with the second set of upper connections;

the second set of upper connections and the first set of lower connections having parallel axes that are misaligned in an unplugged state, the misalignment creating deformation of at least one of the upper member and the lower member during insertion of the plurality of studs into the plurality of jacks when the second set of upper connections and the first set of lower connections are plugged together, and the deformation creating a resultant force between the second set of upper connections and the first set of lower connections.

2. The connector stackable system according to claim 1, wherein the lower member body holds a second set of lower connections comprising at least one of the plurality of studs and the plurality of jacks that are opposite with the first set of lower connections.

3. The stackable connector system according to claim 2, wherein the second set of lower connections is substantially aligned with the second set of upper connections.

4. The stackable connector system according to claim 1, wherein the first set of upper connections and the first set of lower connections have parallel axes that are substantially aligned.

5. The stackable connector system according to claim 1, wherein:

the upper member body comprises a body spring, the misalignment creates deformation of the upper member body and the body spring during insertion of the plurality of studs into the plurality of jacks, and the deformation of the upper member body and the body spring contributes to the resultant force.

6. The stackable connector system according to claim 1, wherein the misalignment creates deformation of the second set of upper connections during insertion of the plurality of studs into the plurality of jacks, and wherein the deformation of the second set of upper connections contributes to the resultant force.

7. The stackable connector system according to claim 1, wherein each of the plurality of studs of the upper member is galvanically connected to a different one of the plurality of jacks of the upper member.

8. The stackable connector system according to claim 1, comprising an additional member comprising an additional member body holding a first set of additional connections comprising at least one of the plurality of studs and the plurality of jacks that are opposite and correspond with the first set of upper connections, the first set of upper connections and the first set of additional connections having parallel axes that are misaligned in an unplugged state, the misalignment creating deformation of at least one of the upper member and the additional member during insertion of the plurality of studs into the plurality of jacks when the first set of upper connections and the first set of additional connections are plugged together, and the deformation creating a resultant force between the first set of upper connections and the first set of additional connections.

9. The stackable connector system according to claim 2, comprising an additional member comprising an additional member body holding a first set of additional connections comprising at least one of the plurality of studs and the plurality of jacks that are opposite and correspond with the second set of lower connections, the first set of additional connections and the second set of lower connections having parallel axes that are misaligned in an unplugged state, the misalignment creating deformation of at least one of the lower member and the additional member during insertion of the plurality of studs into the plurality of jacks when the second set of lower connections and the first set of additional connections are plugged together, and the deformation creating a resultant force between the second set of lower connections and the first set of additional connections.

10. The stackable connector system according to claim 1, comprising a gap between the upper member body and the lower member body when the second set of upper connections and the first set of lower connections are fully plugged together.

11. The stackable connector system according to claim 1, wherein the upper member comprises:

an opening configured to receive a connecting wire; and an attachment mechanism configured to secure the connecting wire in the opening to electrically connect the connecting wire to one or both of:

one connection from the first set of upper connections, and one connection from the second set of upper connections.

12. The stackable connector system according to claim 1, wherein each of the plurality of jacks comprises a jack widening feature or a jack narrowing feature.

13. The stackable connector system according to claim 12, wherein each of the plurality of studs comprises a stud widening feature that fits into the jack widening feature or a stud narrowing feature that fits into the jack narrowing feature.

14. The stackable connector system according to claim 12, wherein each of the plurality of studs comprises a central region configured to fit into the jack widening feature and extend beyond a jack narrowing feature.

15. The stackable connector system according to claim 1, wherein each of the plurality of studs comprises a locking feature at a top of each of the plurality of the studs, the locking feature configured to fit into a top of each of the plurality of jacks.

16. The stackable connector system according to claim 15, wherein the locking feature has a thickness greater than a thickness of an adjacent base portion of each of the plurality of studs.

17. The stackable connector system according to claim 1, wherein a number of the at least one of the plurality of studs and the plurality of jacks of the first set of upper connections is unequal to a number of the at least one of the plurality of studs and the plurality of jacks of the second set of upper connections.

* * * * *